US007603062B2

(12) United States Patent
Shimojo et al.

(10) Patent No.: US 7,603,062 B2
(45) Date of Patent: Oct. 13, 2009

(54) CONDUCTIVE MEMBER, AND CHARGING ROLLER, PROCESS CARTRIDGE AND IMAGE FORMING APPARATUS USING SAME

(75) Inventors: Eiji Shimojo, Tokyo (JP); Masanori Kawasumi, Kanagawa (JP); Yoshiyuki Kimura, Tokyo (JP); Masahiko Satoh, Tokyo (JP); Takeshi Uchitani, Kanagawa (JP); Hideki Zemba, Kanagawa (JP); Yutaka Narita, Kanagawa (JP); Shunichi Hashimoto, Kanagawa (JP); Eisaku Murakami, Tokyo (JP); Shin Kayahara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 322 days.

(21) Appl. No.: 11/517,390

(22) Filed: Sep. 8, 2006

(65) Prior Publication Data

US 2007/0065178 A1 Mar. 22, 2007

(30) Foreign Application Priority Data

Sep. 16, 2005 (JP) ..... 2005-269332

(51) Int. Cl.
*G03G 15/02* (2006.01)

(52) U.S. Cl. ..... 399/168; 399/176

(58) Field of Classification Search ..... 399/168, 399/115, 176, 174

See application file for complete search history.

(56) References Cited

U.S. PATENT DOCUMENTS

| | | | |
|---|---|---|---|
| 6,990,305 | B2 | 1/2006 | Kosuge et al. |
| 2004/0109706 | A1 | 6/2004 | Kosuge et al. |
| 2005/0100365 | A1 | 5/2005 | Narita et al. |
| 2006/0062594 | A1 | 3/2006 | Kawasumi et al. |
| 2006/0115292 | A1 | 6/2006 | Sampe et al. |
| 2006/0270541 | A1 * | 11/2006 | Narita et al. ..... 492/47 |

FOREIGN PATENT DOCUMENTS

| | | |
|---|---|---|
| JP | 3-52058 | 8/1991 |
| JP | 3-240076 | 10/1991 |

(Continued)

OTHER PUBLICATIONS

U.S. Appl. No. 12/049,838, filed Mar. 17, 2008, Senoh, et al.

*Primary Examiner*—David M Gray
*Assistant Examiner*—Andrew V Do
(74) *Attorney, Agent, or Firm*—Oblon, Spivak, McClelland, Maier & Neustadt, L.L.P.

(57) ABSTRACT

A conductive member, including a long conductive supporting body, an electrical resistance adjusting layer, disposed on the outer circumferential surface of the conductive supporting body and having a reduced diameter section at either end, and a pair of gap maintaining members which are respectively fitted onto said reduced diameter sections of the electrical resistance adjusting layer. The outer circumferential surfaces of the gap maintaining members have a height differential with respect to the outer circumferential surface of the electrical resistance adjusting layer, in such a manner that when abutted against an image carrier, a prescribed gap is formed between the outer circumferential surface of the image carrier and the outer circumferential surface of the electrical resistance adjusting layer. An interval between the end faces of the electrical resistance adjusting layer and the faces of the gap maintaining members opposing the end faces satisfies a predetermined relationship.

15 Claims, 8 Drawing Sheets

FOREIGN PATENT DOCUMENTS

| | | |
|---|---|---|
| JP | 4-358175 | 12/1992 |
| JP | 6-93150 | 11/1994 |
| JP | 2001-296723 | 10/2001 |
| JP | 2004-309762 | 11/2004 |
| JP | 2004-354477 | 12/2004 |
| JP | 2005-91818 | 4/2005 |

* cited by examiner

DISTANCE X2 VS. ENVIRONMENTAL CHANGE IN GAP SIZE BETWEEN GAP MAINTAINING MEMBERS AND ELECTRICAL RESISTANCE ADJUSTING LAYER

DATA AFTER LEAVING FOR 72 HOURS IN 27°C 80%RH ENVIRONMENT

DISTANCE X3 VS. ENVIRONMENTAL CHANGE IN GAP SIZE BETWEEN GAP MAINTAINING MEMBERS AND ELECTRICAL RESISTANCE ADJUSTING LAYER

DATA AFTER LEAVING FOR 72 HOURS IN 27°C 80%RH ENVIRONMENT

DISTANCE X4 VS. ENVIRONMENTAL CHANGE IN GAP SIZE BETWEEN GAP MAINTAINING MEMBERS AND ELECTRICAL RESISTANCE ADJUSTING LAYER

DATA AFTER LEAVING FOR 72 HOURS IN 27°C 80%RH ENVIRONMENT

FIG. 15

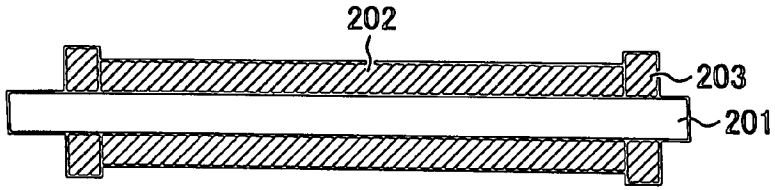

FIG. 16

| | GAP BETWEEN CHARGING MEMBER AND PHOTOSENSITIVE BODY (mm) | ENVIRON-MENTAL CHANGE IN GAP (mm) | GAP BETWEEN CHARGING MEMBER AND PHOTOSENSITIVE BODY AFTER PASSING 300,000 SHEETS (mm) | TONER ADHERENCE TO ROLLER SURFACE AFTER PASSING 300,000 SHEETS | IMAGE AFTER PASSING 300,000 SHEETS |
|---|---|---|---|---|---|
| EXAMPLE 1 | 0.05±0.012 | 0.006 | 0.05±0.013 | GOOD | GOOD |
| EXAMPLE 2 | 0.05±0.010 | 0.008 | 0.05±0.011 | GOOD | GOOD |
| EXAMPLE 3 | 0.05±0.010 | 0.010 | 0.05±0.011 | GOOD | GOOD |
| EXAMPLE 4 | 0.05±0.012 | 0.008 | 0.05±0.013 | GOOD | GOOD |
| COMPARATIVE EXAMPLE 1 | 0.05±0.030 | 0.023 | 0.04±0.050 | ADHERENCE OF TONER | NON-UNIFORMITY IN IMAGE |
| COMPARATIVE EXAMPLE 2 | 0.03±0.020 | 0.025 | 0.03±0.040 | ADHERENCE OF TONER | NON-UNIFORMITY IN IMAGE |
| COMPARATIVE EXAMPLE 3 | 0.05±0.012 | 0.030 | 0.05±0.015 | ADHERENCE OF TONER | NON-UNIFORMITY IN IMAGE |

ROLLER WITH COUNTERMEASURE FOR SWELLING (INVENTION)
ROLLER WITH COUNTERMEASURE FOR SWELLING (PRIOR ART)

CONDUCTIVE MEMBER, AND CHARGING ROLLER, PROCESS CARTRIDGE AND IMAGE FORMING APPARATUS USING SAME

BACKGROUND OF THE INVENTION

1. Field of the Invention

The present invention relates to a conductive member which is disposed in the vicinity of the image carrier of an image forming apparatus of an electrophotographic type and is used as a charging member, transfer member, or the like, and in particular, it relates to a charging roller, process cartridge and image forming apparatus which use such a conductive member.

2. Description of the Background Art

Conventionally, in an image forming apparatus of an electrophotographic type, such as a copying machine, a laser beam printer, or a facsimile machine, conductive members are used as a charging roller which applies charge to an image carrier (also called "photosensitive body" below), and as a transfer. roller which performs transfer processing of toner on the photosensitive body.

For example, as prior art technology relating to an image forming apparatus using a charging roller of this kind, Japanese Patent Application Publication No. S63-149668 and Japanese Patent Application Publication No. H01-267667 disclose a contact charging method in which a charging roller is placed in contact with the photosensitive body. However, a contact charging method involves problems of the following kind.

Namely, the material constituting the charging roller seeps out from the charging roller and becomes attached to the surface of the charged body, giving rise to a charging roller trace which adheres to the surface of the charged body. In particular, the seeping described above makes toner adherence more liable to occur. Furthermore, the charging roller which makes contact with the charged body oscillates when an AC voltage is applied to the charging roller, and this creates a charging sound. Moreover, the toner on the photosensitive body becomes attached to the charging roller, and this causes charging performance to decline. Yet further, if the photosensitive body is halted for a long period of time, the material constituting the charging roller becomes attached to the photosensitive body and the charging roller suffers permanent deformation.

As technology for resolving problems of this kind, a proximity charging method, in which the charging roller is placed in the proximity of the photosensitive body, has been proposed instead of the contact charging method described above. More specifically, Japanese Patent Application Publication No. H03-240076 discloses a proximity charging type of charging roller in which the proximity gap between a charging roller and a charged body is set to 5 to 300 μm, an outer layer made of EPDM, or the like, whose resistance has been reduced to a prescribed extent by using carbon, or the like, is provided on the outer side of a conductive metal core, and spacer rings made of nylon, tetrafluoroethylene (product name: Teflon (registered trademark)), or the like, are provided in an integrated fashion on either side end section of the roller and extending in the circumferential direction of the roller. Furthermore, Japanese Patent Application Publication No. H04-358175 discloses a proximity charging type of charging roller in which the proximity gap between a charging roller and a charged body is set to 1 mm or less, the roller comprises a conductive metal core and a resistance layer, and spacer rings made of an insulating material are provided in an integrated fashion on either side end section of the resistance layer.

In proximity charging methods of this kind, the charging roller and the photosensitive body are mutually opposing in such a manner that the closest distance (gap) between same is 50 to 200 m, and by applying a voltage to the charging roller, the photosensitive body becomes charged. In a proximity charging method, since the charging apparatus and the photosensitive body do not make contact with each other, then there is no occurrence of problems which arise in a contact charging method, such as adherence of the material constituting the charging roller to the photosensitive body, or permanent deformation occurring due to a prolonged idle period of the photosensitive body. Furthermore, the proximity charging method is also advantageous in respect of the problem of degraded charging performance due to adherence of toner, or the like, from the photosensitive body to the charging roller, since the amount toner adhering to the charging roller is reduced.

However, although the proximity charging method has is the advantages described above in comparison with a contact charging method, it involves the following two problems, which make practical application difficult. More specifically, in the proximity charging method, it is difficult to maintain a uniform gap between the charging member and the photosensitive body, and furthermore, charging non-uniformities are liable to occur due to variation in the gap between the charging member and the photosensitive body. When charging non-uniformities occur, they can give rise to image defects, such as adherence of toner to white areas of the paper. With respect to the problem of maintaining a uniform gap in the section of closest proximity between the charging member and the photosensitive body, in order to prevent the occurrence of image defects due to charging non-uniformities, the variation in the size of the gap in the section of closest proximity between the charging member and the photosensitive body must be restricted to approximately 20 μm, for example.

As a device for maintaining the gap between the charging roller and the photosensitive body, Japanese Patent Application Publication No. 2001-296723, for example, discloses a non-contact charging apparatus in which a jointed tape-shaped member is installed as a gap management member on the outer circumference of either end section of an elastic roller section, thereby forming a gap with respect to the surface of an image carrier, and although it resolves the problems described above in the short term, the elastic rubber used for the charging roller is liable to suffer flatting over time, and with use over a long period, it is not possible to maintain the gap between the photosensitive body and the charging roller. Furthermore, with a long period of use, factors such as abrasion of the tape-shaped member, infiltration of toner in between the charging roller and the tape-shaped member, and adherence of solid toner to same, and the like, make it impossible to maintain the gap between the photosensitive body and the charging roller.

Furthermore, Japanese Patent Application Publication No. 2004-354477 discloses a configuration in which a thermoplastic resin composition having a durometer hardness of HDD 30 or above or HDD 70 or below, and wear characteristics in a Taber abrasion tester of 10 mg/1000 cycles or less, is used as a gap maintaining member, and gap maintaining members of this kind are pressure-fitted onto either end section of a roller. According to this composition, as described in more detail below with respect to the drawings, long-term reliability is improved by means of the tape-shaped gap maintaining members.

Japanese Patent Application Publication No. 2005-076138 discloses technology for simultaneous processing, in other words, simultaneous removal processing of a gap maintaining member and an electrical resistance adjusting layer, whereby it becomes possible accurately to control the gap between a charging roller and a contacting member against which it is abutted, for example. However, if the electrical resistance adjusting layer and the gap maintaining member are made of different materials, then due to the difference in their water absorptivity, there will be a difference in the amount of dimensional variation they experience with change in the ambient conditions, thus leading to the problem of variation in the size of the gap. More specifically, the gap maintaining member and the electrical resistance adjusting layer are usually formed from different materials, in consideration of the adherence characteristics of solid toner, but since an ion-conductive agent is used as the resistance adjusting agent of the electrical resistance adjusting layer, then it has high water absorptivity, and in high-temperature and high-humidity conditions, the electrical resistance adjusting layer absorbs moisture and is liable to experience dimensional change. On the other hand, the gap maintaining member is desirably made of an olefin-based material, in view of its insulating properties and resistance to adherence of solid toner, but the olefin-based material has low water absorptivity and undergoes little dimensional change in high-temperature and high-humidity conditions, compared to an electrical resistance adjusting layer. Consequently, there is a problem in that the gap (step difference), which has been formed with high precision, will suffer variations as a result of changes in the ambient conditions.

In order to resolve problems of this kind, Japanese Patent Application Publication No. 2005-019517 proposes a composition in which a step section is provided in one or more steps in the vicinity of either end of the electrical resistance adjusting layer, as described hereinafter with reference to the drawing, and a gap maintaining member is abutted against and fixed to two or more of the faces constituting each step section of the electrical resistance adjusting layer. However, when carrying out removal processing, such as cutting and polishing, on the gap maintaining member, and especially if the gap maintaining member has a small thickness, peeling or pulling of the end sections of the gap maintaining member occurs due to the stress created by the cutting blade and there is a risk that the shape of the gap maintaining member will be deformed, thus causing variations in the size of the gap.

Technologies relating to the present invention are also disclosed in, for example, Japanese Patent Application Publication No. H03-052058 and Japanese Patent Application Publication No. H06-093150.

SUMMARY OF THE INVENTION

The present invention was devised in view of the aforementioned problems of the prior art, an object thereof being to provide a highly durable conductive member which can maintain a stable gap with respect to an abutting member, even when used over a long period of time, and to provide a charging roller, process cartridge and image forming apparatus using this conductive member.

In an aspect of the present invention, a conducive member comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of said electrical resistance adjusting layer, in such a manner that when abutted against an image carrier, a prescribed gap is formed between the outer circumferential surface of the image carrier and the outer circumferential surface of the electrical resistance adjusting layer, and taking $X_2$ to be the thickness of the portions of the gap maintaining members which oppose the end faces of the electrical resistance adjusting layer, the relationship 1 mm$\leqq x_2 \leqq$3 mm is satisfied.

In another aspect of the present invention, a conductive member comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against an image carrier, a prescribed gap is formed between the outer circumferential surface of the image carrier and the outer circumferential surface of the electrical resistance adjusting layer, and taking $X_3$ to be the interval between the end faces of the electrical resistance adjusting layer and the faces of the gap maintaining members opposing the end faces, the relationship 0.1 mm$\leqq X_3 \leqq$1 mm is satisfied.

In another aspect of the present invention, a conductive member comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against an image carrier, a prescribed gap is formed between the outer circumferential surface of the image carrier and the outer circumferential surface of the electrical resistance adjusting layer, and taking $X_4$ to be the interval between the faces of the gap maintaining members which oppose the end faces of the electrical resistance adjusting layer, and the step difference faces of the reduced diameter sections of the electrical resistance adjusting layer, $X_4$ is 5 mm or greater, and is shorter than the length from the faces of the gap maintaining members which oppose the end faces of the electrical resistance adjusting layer to the positions on the electrical resistance adjusting layer opposing the end sections which correspond to the image forming region of the image carrier.

In another aspect of the present invention, a charging roller of a charging apparatus uniformly charges the surface of an image carrier of an image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_2$ to be the thickness of the portions of the gap maintaining members which oppose the end faces of the electrical resistance adjusting layer, the relationship 1 mm$\leqq x_2 \leqq$3 mm is satisfied.

In another aspect of the present invention, a charging roller of a charging apparatus uniformly charges the surface of an image carrier of an image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_3$ to be the interval between the end faces of the electrical resistance adjusting layer and the faces of the gap maintaining members opposing the end faces, the relationship 0.1 mm$\leqq x_3 \leqq$1 mm is satisfied.

In an aspect of the present invention, a charging roller of a charging apparatus uniformly charges the surface of an image carrier of an image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_4$ to be the interval between the faces of the gap maintaining members which oppose the end faces of the electrical resistance adjusting layer, and the step difference faces of the reduced diameter sections of the electrical resistance adjusting layer, $X_4$ is 5 mm or greater, and is shorter than the length from the faces of the gap maintaining members which oppose the end faces of the electrical resistance adjusting layer to the positions on the electrical resistance adjusting layer opposing the end sections which correspond to the image forming region of the image carrier.

In an aspect of the present invention, a process cartridge is provided in which an image carrier and a charging apparatus arranged in the proximity of the image carrier are integrally formed. The process cartridge is formed detachably with respect to the main body of an image forming apparatus. The charging apparatus comprises a charging roller which uniformly charges the surface of the image carrier of the image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_2$ to be the thickness of the portions of the gap maintaining members which oppose the end faces of the electrical resistance adjusting layer, the relationship 1 mm$\leqq x_2 \leqq$3 mm is satisfied.

In another aspect of the present invention, a process cartridge is provided in which an image carrier and a charging apparatus arranged in the proximity of the image carrier are integrally formed. The process cartridge is formed detachably with respect to the main body of an image forming apparatus. The charging apparatus comprises a charging roller which uniformly charges the surface of the image carrier of the image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_3$ to be the interval between the end faces of the electrical resistance adjusting layer and the faces of the gap maintaining members opposing the end faces, the relationship 0.1 mm$\leqq x_3 \leqq$1 mm is satisfied.

In an aspect of the present invention, a process cartridge is provided in which an image carrier and a charging apparatus arranged in the proximity of the image carrier are integrally formed. The process cartridge is formed detachably with respect to the main body of an image forming apparatus. The charging apparatus comprises a charging roller which uniformly charges the surface of the image carrier of the image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_4$ to be the interval between the faces of the gap maintaining members which oppose the end faces of the electrical resistance adjusting layer, and the step difference faces of the reduced diameter sections of the electrical resistance adjusting layer, $X_4$ is 5 mm or greater, and is shorter than the length from the faces of the gap maintaining members which oppose the end faces of the electrical resistance adjusting layer to the positions on the electrical resistance adjusting layer opposing the end sections which correspond to the image forming region of the image carrier.

In another aspect of the present invention, an image forming apparatus comprises an image carrier; a charging apparatus which charges the surface of the image carrier; an exposure apparatus which writes a latent image by exposing the charged surface of the image carrier on the basis of image data; a developing apparatus which supplies toner to the electrostatic latent image formed on the surface of the image carrier to make the image visible; a cleaning apparatus which recovers toner remaining on the surface of said image carrier after image transfer; and a process cartridge in which the image carrier and the charging apparatus arranged in the proximity of the image carrier are integrally formed. The process cartridge is formed detachably with respect to the main body of an image forming apparatus.

In another aspect of the present invention, an image forming apparatus comprises an image carrier; a charging apparatus which charges the surface of an image carrier; an exposure apparatus which writes a latent image by exposing the charged surface of the image carrier on the basis of image data; a developing apparatus which supplies toner to the electrostatic latent image formed on the surface of the image carrier to make the image visible; a cleaning apparatus which recovers toner remaining on the surface of said image carrier after image transfer; and a charging roller of the charging apparatus which uniformly charges the surface of an image carrier of an image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_2$ to be the thickness of the portions of the gap maintaining members which oppose the end faces of the electrical resistance adjusting layer, the relationship 1 mm$\leqq x_2 \leqq$3 mm is satisfied.

In another aspect of the present invention, an image forming apparatus comprises an image carrier; a charging apparatus which charges the surface of an image carrier; an exposure apparatus which writes a latent image by exposing the charged surface of the image carrier on the basis of image data; a developing apparatus which supplies toner to the electrostatic latent image formed on the surface of the image carrier to make the image visible; a cleaning apparatus which recovers toner remaining on the surface of the image carrier after image transfer; and a charging roller of the charging apparatus which uniformly charges the surface of an image carrier of an image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_3$ to be the interval between the end faces of the electrical resistance adjusting layer and the faces of the gap maintaining members opposing the end faces, the relationship 0.1 mm$\leqq x_3 \leqq$1 mm is satisfied.

In another aspect of the present invention, an image forming apparatus comprises an image carrier; a charging apparatus which charges the surface of an image carrier; an exposure apparatus which writes a latent image by exposing the charged surface of the image carrier on the basis of image data; a developing apparatus which supplies toner to the electrostatic latent image formed on the surface of the image carrier to make the image visible; a cleaning apparatus which recovers toner remaining on the surface of the image carrier after image transfer; and a charging roller of the charging apparatus which uniformly charges the surface of the image carrier of the image forming apparatus. The charging roller is constituted by a conductive member which comprises a long conductive supporting body; an electrical resistance adjusting layer, disposed on the outer circumferential surface of the conductive supporting body and having a reduced diameter section at either end; and a pair of gap maintaining members which are respectively fitted onto the reduced diameter sections of the electrical resistance adjusting layer. The outer circumferential surfaces of the gap maintaining members have a height differential with respect to the outer circumferential surface of the electrical resistance adjusting layer, in such a manner that when abutted against the image carrier, a prescribed gap is formed between the outer circumferential surface of the image carrier and the outer circumferential surface of the electrical resistance adjusting layer, and taking $X_4$ to be the interval between the faces of the gap maintaining members which oppose the end faces of the electrical resistance adjusting layer, and the step difference faces of the reduced diameter sections of the electrical resistance adjusting layer, $X_4$ is 5 mm or greater, and is shorter than the length from the faces of the gap maintaining members which oppose the end faces of the electrical resistance adjusting layer to the positions on the electrical resistance adjusting layer opposing the end sections which correspond to the image forming region of the image carrier

BRIEF DESCRIPTION OF THE DRAWINGS

The above and other objects, features and advantages of the present invention will become more apparent from the following detailed description taken with the accompanying drawings in which

FIG. 15 is an enlarged cross-sectional diagram showing the end section of a charging roller according to the present embodiment;

FIG. 16 is a table showing the evaluation results of a calculation of the amount of change in the gap between the charging member and a photosensitive body, in different environments.

DESCRIPTION OF THE PREFERRED EMBODIMENTS

Before describing the present invention, the prior art technology and the problems relating to same will be described with respect to the drawings.

Figure 1:
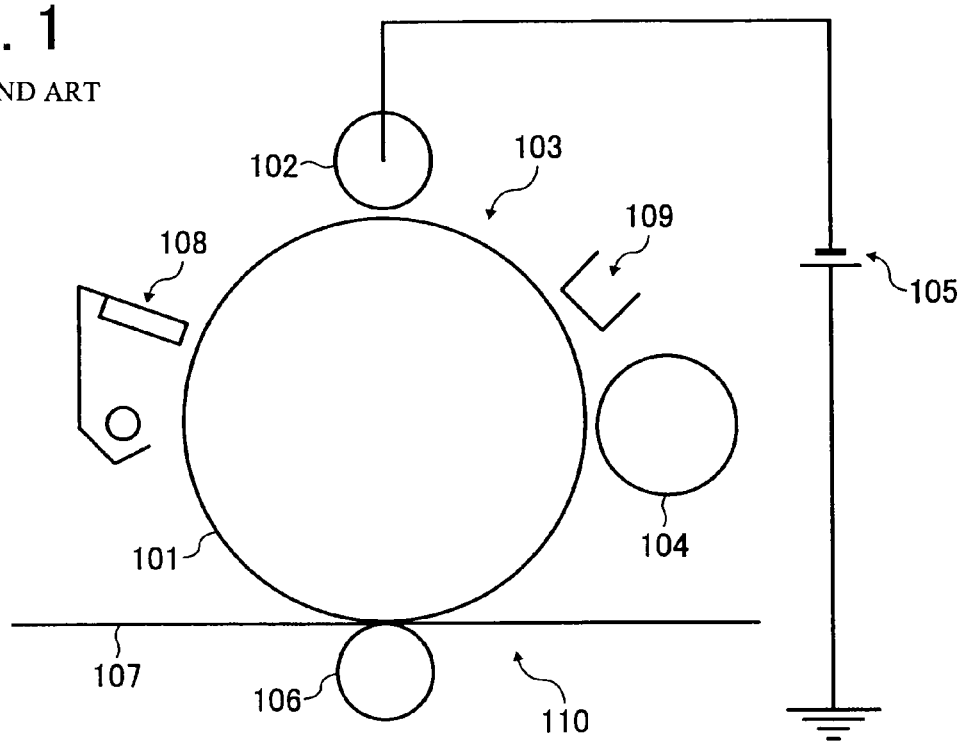
FIG. 1 BACKGROUND ART
FIG. 1 is a cross-sectional diagram showing the composition of a conventional image forming apparatus using a conductive member.

FIG. 1 is a general schematic drawing of an image forming apparatus of an electrophotographic type which uses a conductive member as a charging roller. As shown in the drawing, this image forming apparatus chiefly comprises: a drum-shaped photosensitive body 101 on which an electrostatic latent image is formed; a charging roller 102 forming a charging member which is disposed in contact with or in the proximity of the photosensitive body 101 and performs charging; an exposure apparatus (not illustrated) which irradiates exposure light 103, such as laser light or light reflected from an original manuscript; a developing roller 104 which deposits toner onto the electrostatic latent image on the photosensitive body 101; a voltage application power source 105 for applying a voltage to the charging roller 102; a transfer roller 106 which transfers the toner image on the photosensitive body 101 onto recording paper 107; a cleaning apparatus 108 which cleans the photosensitive body 101 after the transfer process; and a surface potentiometer 109 which measures the surface potential of the photosensitive body 101.

Figure 2:
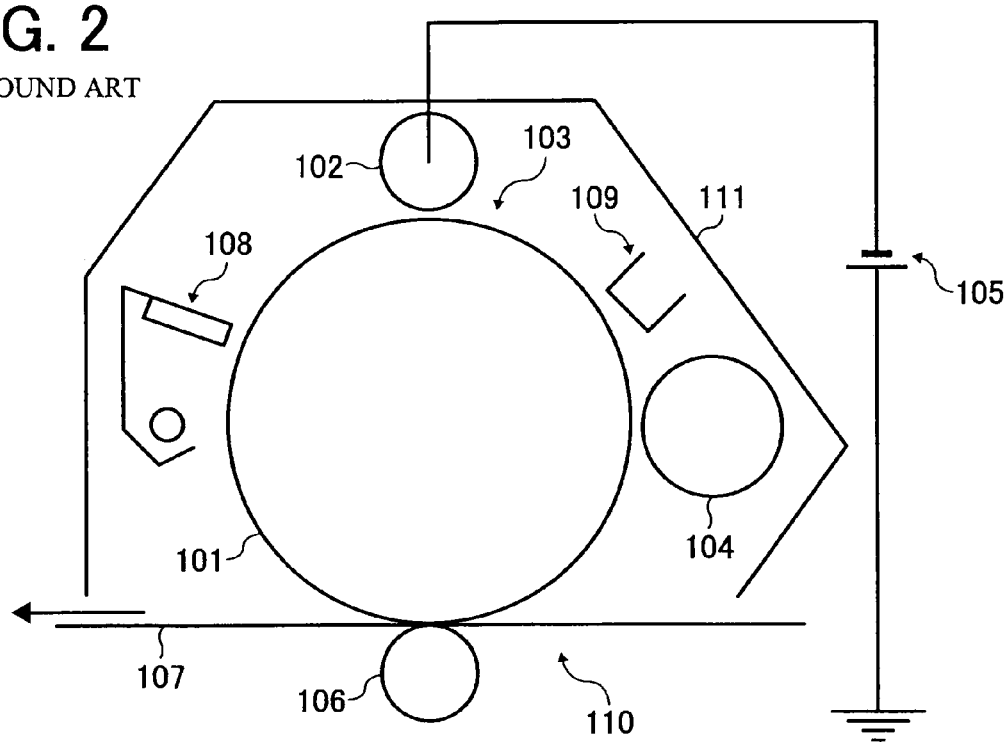
FIG. 2 BACKGROUND ART
FIG. 2 is a diagram for describing a conventional image forming apparatus using a process cartridge.

FIG. 2 shows a process cartridge which comprises a photosensitive body 101 and a charging roller 102. As shown in the drawing, there are also cases where a process cartridge which encompasses a photosensitive body 101, charging roller 102, developing roller 104, and cleaning apparatus 108, is installed inside the image forming apparatus.

In the image forming apparatus of this kind, an image is formed by means of the following procedure. More specifically, firstly, the surface of the photosensitive body 101 is charged to a prescribed electric potential by means of the charging roller 102. Thereupon, exposure light 103 is irradiated onto the photosensitive body 101 by means of the exposure apparatus (not illustrated), thereby forming an electrostatic latent image corresponding to the desired image. Next, the electrostatic latent image is developed with toner, by means of the developing roller 104, thereby forming a toner image (real image) on the photosensitive body 101. Subsequently, the toner image on the photosensitive body 101 is transferred to the recording paper 107 by means of the transfer roller 106. After image transfer, any toner which has not been transferred and which remains on the photosensitive body 101 is cleaned away by means of the cleaning apparatus 108. The recording paper 107 onto which the toner image has been transferred is conveyed to a fixing apparatus (not illustrated). The fixing apparatus fixes the toner onto the recording paper by heating and pressurizing the toner. By repeating a procedure of this kind, a desired image is formed on the recording paper.

Figure 3:
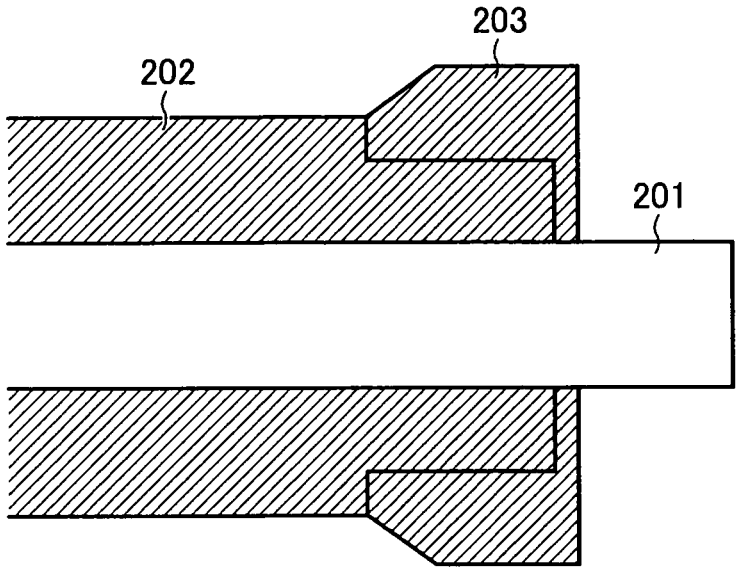
FIG. 3 BACKGROUND ART
FIG. 3 is a cross-sectional diagram showing the composition of a conductive member disclosed in Japanese Patent Application Publication No. 2004-354477.

FIG. 3 shows the composition disclosed in Japanese Patent Application Publication No. 2004-354477. As stated previously, in this configuration, a thermoplastic resin composition having a durometer hardness of HDD 30 or above or HDD 70 or below, and wear characteristics in a Taber abrasion tester of 10 mg/1000 cycles or less, is used as a gap maintaining member, and gap maintaining members of this kind are pressure-fitted onto either end section of the roller. In FIG. 3, to describe the relationship between the electrical resistance adjusting layer 202 of the roller and the gap maintaining members 203, the gap maintaining members 203 are formed at the end sections of the electrical resistance adjusting layer 202, and the gap maintaining members 203 make contact with the end faces of the electrical resistance adjusting layer 202 and the conductive supporting body 201. Consequently, the long-term reliability is improved by means of the tape-shaped gap maintaining members.

Figure 4:
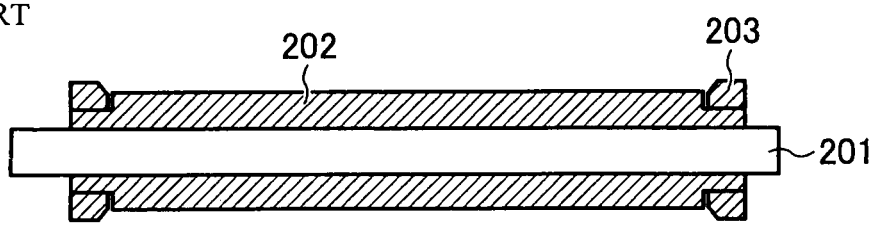
FIG. 4 BACKGROUND ART
FIG. 4 is a cross-sectional diagram showing the composition of a conductive member disclosed in Japanese Patent Application Publication No. 2005-019577.

FIG. 4 shows the composition disclosed in Japanese Patent Application Publication No. 2005-019517. As stated previously, in this composition, a step section is provided in one or more stages in the vicinity of each end of the electrical resistance adjusting layer, and a gap maintaining member makes contact with and is fixed to two or more of the surfaces constituting each step section of the electrical resistance adjusting layer. However, when carrying out removal processing, such as cutting and polishing, on the gap maintaining members, and in particular, if the gap maintaining members have a small thickness, peeling or pulling of the end sections of the gap maintaining members occur due to the stress created by the cutting blade and there is a risk that the shape of the gap maintaining members will be deformed, thus giving rise to variations in the gap.

Below, embodiments of the present invention are described in detail with. reference to the accompanying drawings.

Figure 5:
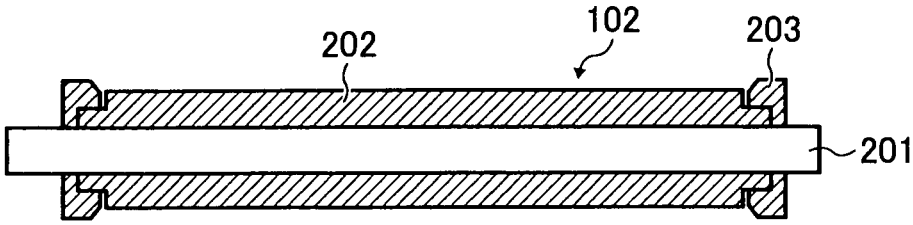
FIG. 5 is cross-sectional diagram showing the structure of a conductive member according to an embodiment of the present invention.

FIG. 5 shows the composition of a conductive member used as a charging roller of the image forming apparatus. This charging roller 102 is a charging roller for a proximity charging method, and it comprises a conductive supporting body 201, an electrical resistance adjusting layer 202 and gap maintaining members 203. The conductive supporting body 201 has a long, cylindrical shape, and a power pack (voltage application power source) (not illustrated) for applying voltage to the charging roller is connected to the end section thereof. The electrical resistance adjusting layer 202 has a cylindrical shape disposed on the circumferential surface of the conductive supporting body 201, using the conductive supporting body 201 as a central axis, and reduced diameter sections are provided in the vicinity of either end of the electrical resistance adjusting layer 202. The gap maintaining members 203 each have a cylindrical shape and are fitted respectively onto the outer circumferential surface of the reduced diameter section at either end of the electrical resistance adjusting layer 202.

Figure 6:
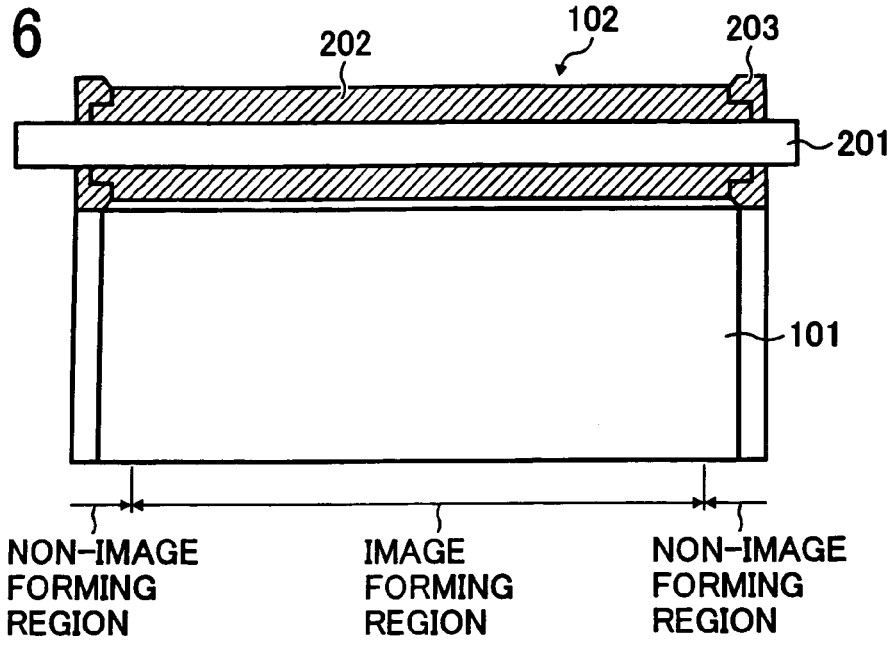
FIG. 6 is a diagram showing a state where the conductive member is arranged on a photosensitive body.

FIG. 6 shows a state where the charging roller 102 shown in FIG. 5 is arranged in the proximity of a photosensitive body 101, which forms an image carrier. The charging roller 102 is disposed so as to abut against the photosensitive drum with a desired pressure. The charging roller 102 uses a proximity charging method; the outer diameter of the electrical resistance adjusting layer 202 is formed so as to be slightly smaller than the outer diameter of the gap maintaining members 203, and when the outer circumferential surfaces of the gap maintaining members 203 on the charging roller 102 abut against the outer circumferential surface of the photosensitive body 101, a gap is formed between the outer circumferential surface of the electrical resistance adjusting layer 202 and the outer circumferential surface of the photosensitive body drum 101. Moreover, the charging roller 102 is disposed in such a manner that the gap maintaining members 203 abut against the regions of the photosensitive body 101 outside the image forming region (non-image-forming regions). By applying a voltage to the charging roller 102 in this sate, it is possible to charge the photosensitive drum 101.

Furthermore, the photosensitive body 101 has a cylindrical shape (drum shape). Therefore, by driving the charging roller 102 and the photosensitive body 101 in rotation, it is possible to change the mutually opposing surfaces in accordance with the rotation, and hence chemical deterioration of the surface due to current stress becomes unlikely to occur, and the product lifespan can be improved. It is not especially necessary that the photosensitive body 101 and the charging roller 102 both have a cylindrical shape, and they may also have an elliptical cylindrical shape.

Since the charging roller 102 uses a proximity charging method, then it is necessary to keep the gap with respect to the photosensitive body 101, uniformly, to a prescribed interval. If the gap becomes larger, then it is necessary to increase the voltage application conditions with respect to the charging roller 102, and hence electrical deterioration and abnormal discharge of the photosensitive body 101 become more liable to occur. Therefore, it is preferable that the gap be 100 μm or less. Furthermore, in order to prevent image defects due to charging non-uniformities when forming an image, it is necessary to suppress the variation in the gap size in the section of closest proximity between the charging roller 102 and the photosensitive body 101, to approximately 20 μm.

A portion of the gap maintaining members 203 has a height differential with respect to the electrical resistance adjusting layer 202. Since it is desirable to keep the gap between the charging roller 102 and the photosensitive body 101 to a prescribed value, the height of a portion of the gap maintaining members 203 is made to be greater than the height of the electrical resistance adjusting layer 202, as shown in FIG. 6. As stated previously, if the gap becomes large, then electrical deterioration and abnormal discharge of the photosensitive drum 101 become more liable to occur, and therefore, desirably, the height differential, in other words, the size of the gap, is 100 μm or less.

Figure 7:
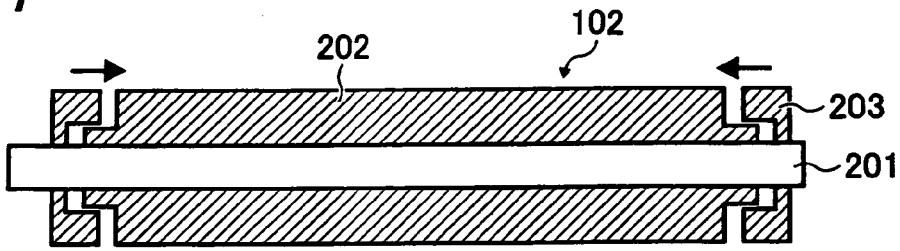
FIG. 7 is a cross-sectional diagram showing an installation process for an electrical resistance adjusting layer and gap maintaining members in a charging roller (conductive member) relating to the present embodiment.
Figure 8:
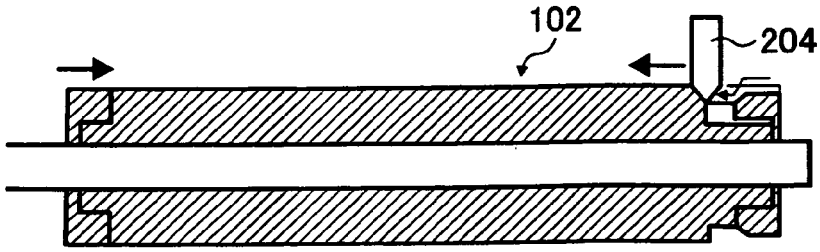
FIG. 8 is a cross-sectional diagram for describing a removal processing step in a charging roller having the aforementioned electrical resistance adjusting layer and gap maintaining members.

FIGS. 7 and 8 show a method of forming gap maintaining members and a charging roller 102 to create a conductive member. The gap maintaining members 203, which have been formed in advance to a desired shape, are pressure fitted onto the respective end sections of the electrical resistance adjusting layer 202, which has reduced diameter sections forming step sections at either end thereof. Thereupon, by performing cutting or other removal processing in a continuous fashion in the gap maintaining members 203 and the electrical resistance adjusting layer 202, a height differential is formed. Consequently, it is possible to set the height differential in a highly precise fashion, with a variation of ±10 μm or less, for example. Desirably, the gap maintaining members 203 are formed to a shape which allows them to be arranged so as to respectively cover a region from the outer circumferential surface of the reduced diameter section at either end of the electrical resistance adjusting layer 202 to the side face of the end section of same, and consequently, peeling or pulling of the end sections of the gap maintaining members 203 due to the stress created by the blade 204 during removal processing is not liable to occur, and hence deformation of the surface shape of the gap maintaining members 203, and any accompanying variation in the gap size, can be suppressed. The prescribed gap between the electrical resistance adjusting layer 202 and the photosensitive body 101, which is the charged body, is set to 10 to 50 μm, for example.

Figure 9:
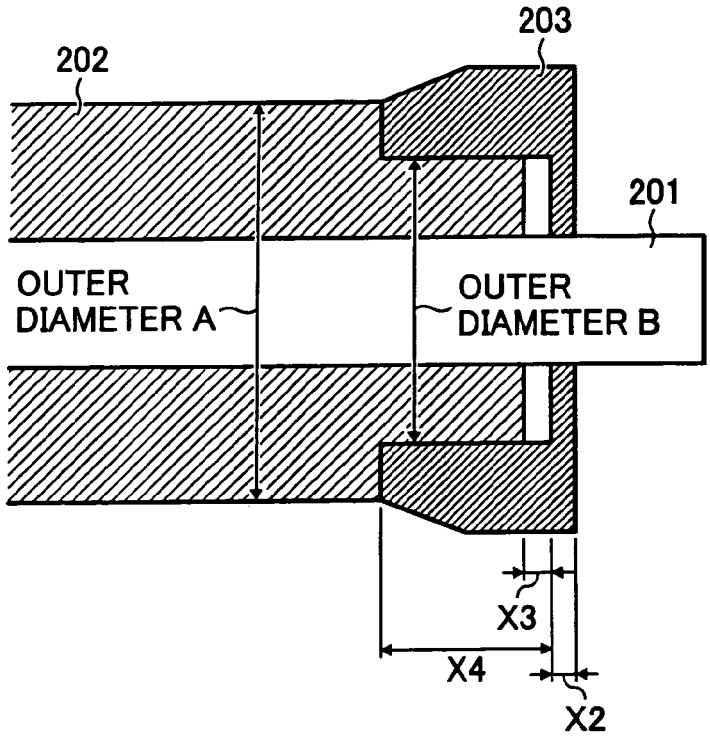
FIG. 9 is an enlarged cross-sectional diagram showing an end section of a charging roller according to the present embodiment.

In FIG. 9, the outer diameter A is the outer diameter of the electrical resistance adjusting layer 202, and the outer diameter B is the outer diameter of the recess sections, which form the reduced diameter sections of the electrical resistance adjusting layer 202.

Figure 10:
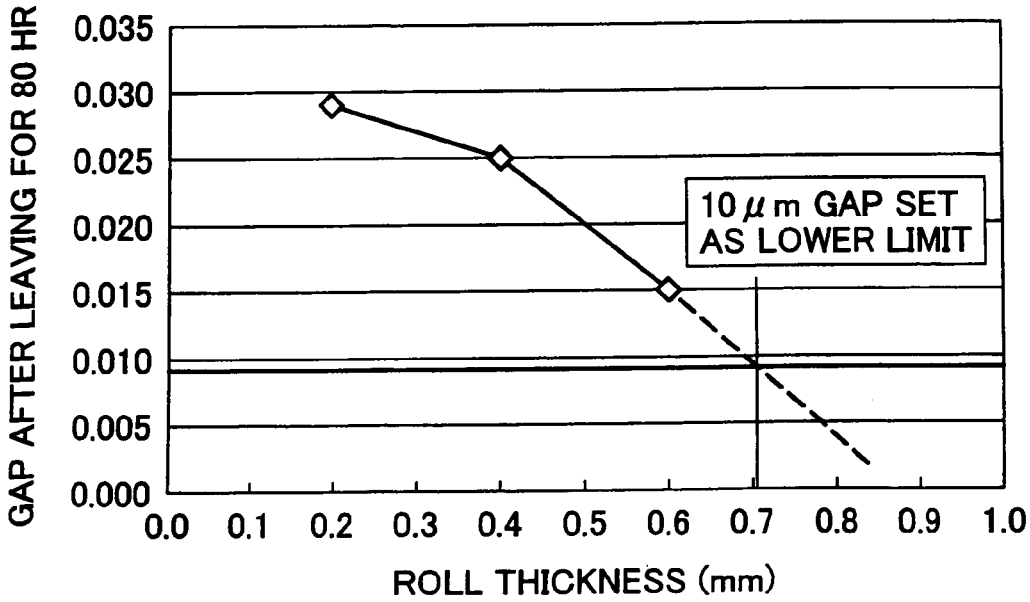
FIG. 10 is a graph showing the relationship between the roll thickness and the gap after leaving for 80 hours in a high-temperature, high-humidity environment.

Furthermore, FIG. 10 shows experimental results which indicate the relationship between the thickness of the roller, and the aforementioned gap after leaving the apparatus in a high-temperature, high-humidity environment for 80 hours. From this, it is desirable that the roller thickness is 0.2 mm to 0.6 mm, the outer diameter A is, for example, 11.17 mm, and the value of B/A is in the range described below.

In the present embodiment, the ratio (B/A) between the outer diameter B of the reduced diameter sections at the end sections, and the outer diameter A of the electrical resistance adjusting layer 202 is in the range of 0.87 to 0.97. A B/A ratio of less than 0.87 (87%) will produce a large differential between the section of the electrical resistance adjusting layer 202 and the section of the spacers (gap maintaining members), in terms of the expansion of the outer roll diameter caused by swelling, and hence it will not be possible to maintain a suitable gap. As the expanding force caused by swelling in the spacer sections becomes weaker, the roll thickness increases, and hence the roll becomes less liable to expand. Conversely, if the outer diameter B of the reduced diameter sections is greater than 0.97 (97%) of A, then the roll thickness becomes small and not only is there insufficient strength, but also the roll itself becomes difficult to manufacture.

Figure 11:
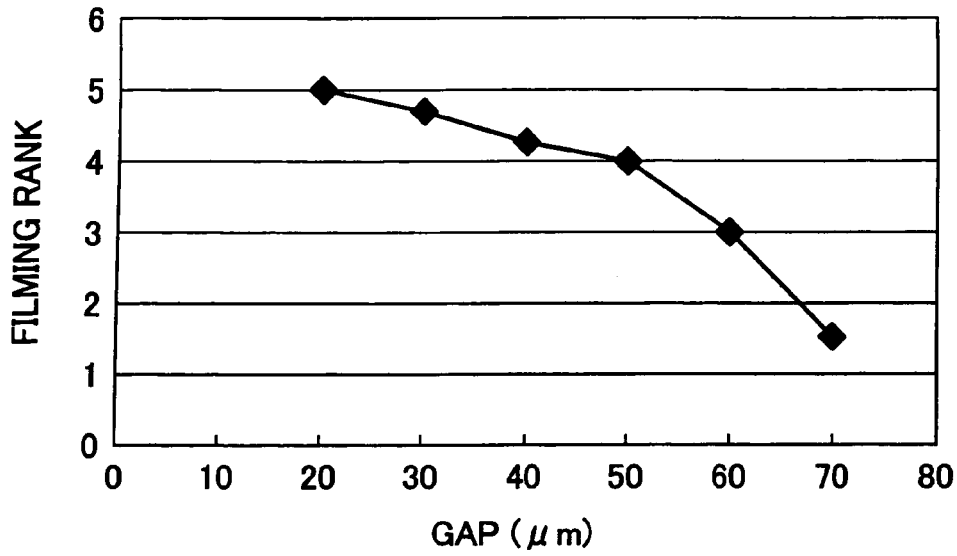
FIG. 11 is a diagram showing the relationship between the gap and filming ranks.

In the present embodiment, the prescribed gap between the electrical resistance adjusting layer 202 and the surface of the charged body, for example, the photosensitive body 101, is in the range of 10 to 50 μm. If the gap is 10 μm or less, then it is difficult to obtain a sufficient gap maintaining effect, due to the adherence of foreign matter, whereas if the gap is 50 μm or greater, then the roll thickness is large, the roll is not liable to expand, and therefore it becomes difficult to maintain the gap. Moreover, if the gap is made large, then the required charging voltage becomes larger, and hence the spare margin with respect to the filming of the photosensitive body declines. A filming rank of 4 or above is a level which will not produce an image abnormality, and from FIG. 11, which is a diagram showing the relationship between filming rank and the gap, it can be seen that if the gap is 50 μm or greater, then image abnormalities due to filming of the photosensitive body will occur. Therefore, 50 μm is set as the maximum value of the gap.

In the present embodiment, the roll thickness, in other words, the thickness of the portions of the gap maintaining members 203 which fit onto the reduced diameter sections of the electrical resistance adjusting layer 202 is in a range corresponding to 7 to 12% of the outer diameter A of the electrical resistance adjusting layer 202. If it is smaller than 7%, then problems occur in that roll strength is insufficient and manufacture becomes difficult. On the other hand, if is greater than 12%, then roll strength is high and it becomes less liable to expand, which means that the gap cannot be maintained.

In the present embodiment, taking the thickness of the sections of the gap maintaining members which oppose the end faces of the electrical resistance adjusting layer to be $X_2$, the relationship 1 mm$\leqq X_2 \leqq$3 mm is satisfied.

Figure 12:
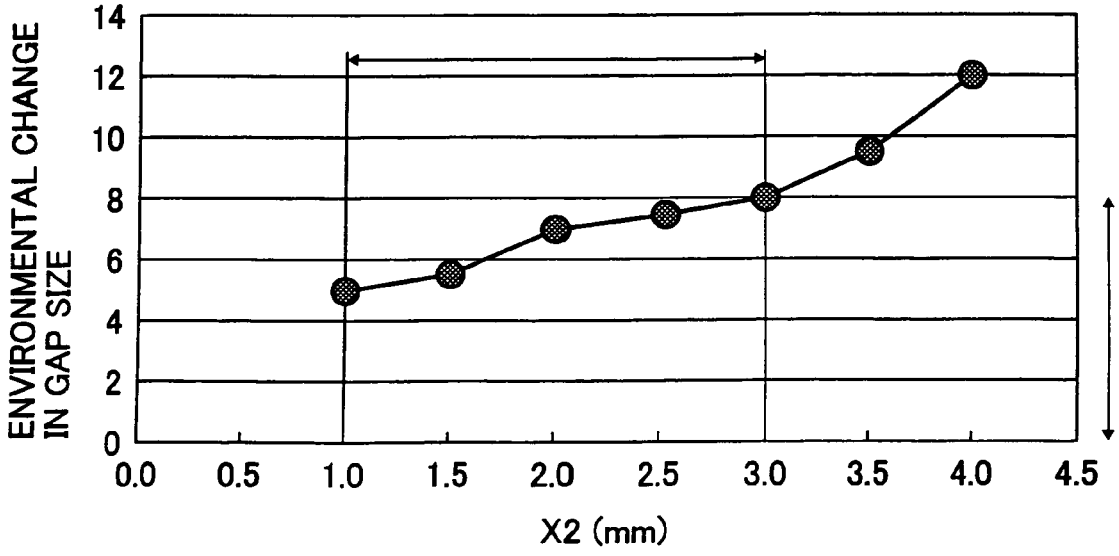
FIGS. 12 to 14 are graphs showing data for specifying the respective dimensions of the charging roller according to the present embodiment.

FIG. 12 shows data for specifying the respective dimensions of a charging roller. In FIG. 12, if $X_2$ is smaller than 1 mm, then processing difficulties arise, and even if processing is possible, the roller will have poor strength. Furthermore, if $X_2$ is greater than 3 mm, then the strength increases, and the effects relating to swelling of the roller section decline. The vertical axis of FIG. 12 shows the swelling width of the gap between the electrical resistance adjusting layer 202 and the surface of the charged body, and increase in the value of this figure indicates swelling of the electrical resistance adjusting layer 202. In FIG. 12, the dimensions $X_3$ and $X_4$, which are described below, are $X_3$=0.1 mm and $X_4$=5 mm.

In other words, in the combination of $X_2$ and $X_3$ and $X_4$, described below, which are the respective dimensions of a gap maintaining member 203 which is most effective with respect to swelling of the electrical resistance adjusting layer 202, $X_2$=1 mm, $X_3$=1 mm, and $X_4$ is equal to the length of the gap maintaining member from the surface opposing the end face of the electrical resistance adjusting layer, to the end portion of the image forming region. Furthermore, the combination of dimensions which produces the smallest effect with respect to the swelling of the electrical resistance adjusting layer 202 is $X_2$>3 mm, $X_3$<0.1 mm and $X_4$<5 mm. Therefore, as the other test conditions for use when specifying the numerical values of $X_2$ to $X_4$, the dimensions $X_2$=3 mm, $X_3$=0.1 mm, $X_4$=5 mm are used as the boundary values of the range where the effect on swelling is small. The same applies to FIGS. 13 and 14.

Figure 13:
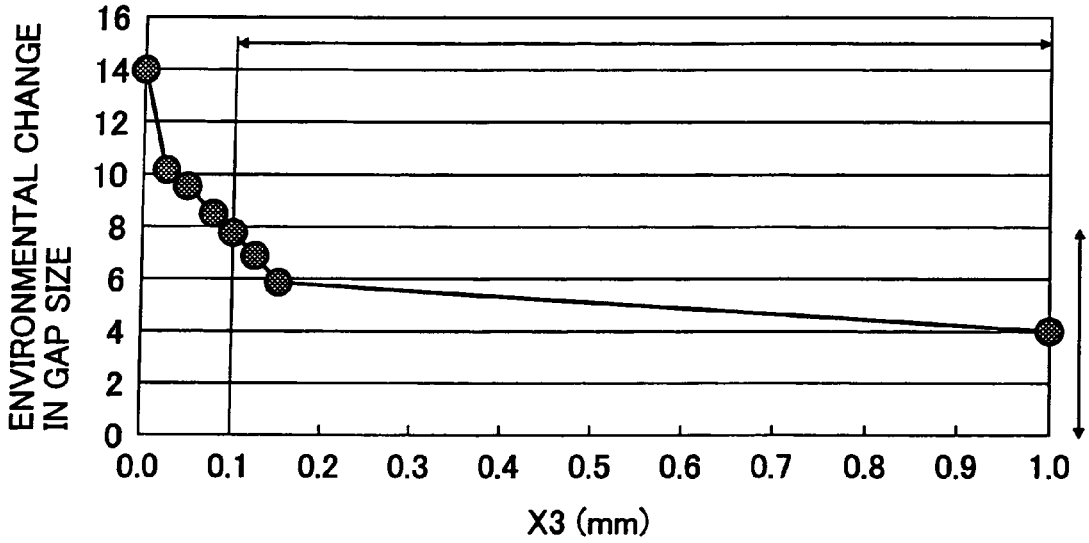

In FIG. 13, which shows data for specifying the respective dimensions of the charging roller, if $X_3$ is smaller than 0.1 mm, then there is no room for movement when the reduced diameter sections of the electrical resistance adjusting layer 202 swell, and hence the margin of tolerance with respect to swelling declines. Moreover, if $X_3$ is greater than 1 mm, then stability is lost in seeking to maintain the prescribed gap between the electrical resistance adjusting layer 202 and the surface of the charged body, with a high precision of 10 to 50 μm. In FIG. 13, $X_2$=3 mm and $X_4$=5 mm.

Figure 14:
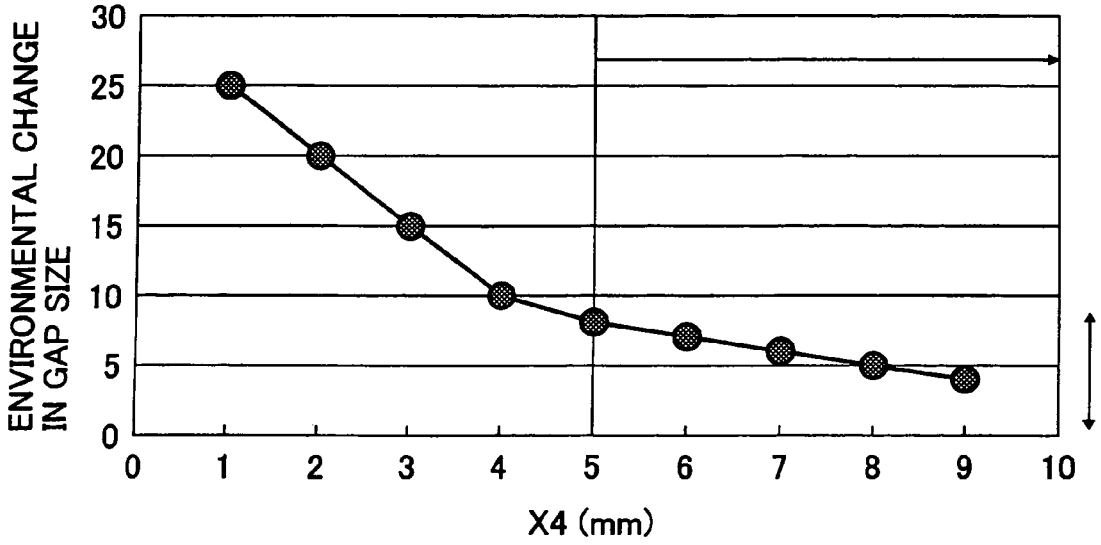

In FIG. 14, which shows data for specifying the respective dimensions of the charging roller, if $X_4$ is smaller than 5 mm, then due to the short length, the roll in the reduced diameter sections of the electrical resistance adjusting layer 202 will rise up when the electrical resistance adjusting layer 202 swells, and the gap to the surface of the charged body will increase. On the other hand, there will be no problem if $X_4$ is longer, up to the positions corresponding to the end sections of the image forming region.

Furthermore, in the resulting conductive member, even if the dimensions of the electrical resistance adjusting layer 202 change due to variation in the ambient conditions, since the gap maintaining members 203 also change in accordance with the change in the electrical resistance adjusting layer 202, then any variation in the gap size is prevented. In FIG. 14, $X_2$=3 mm and $X_3$=0.1 mm. In this case, by coating adhesive onto the contact surfaces between the gap maintaining members 203 and the electrical resistance adjusting layer 202, it is possible to prevent detachment of the gap maintaining members 203 when used over a long period of time. Furthermore, peeling or pulling of the end sections of the gap maintaining members 203 due to the stress created by the cutting blade during removal processing of the gap maintaining members 203 can also be made less liable to occur.

Moreover, by conducting primer processing on the gap maintaining members 203 before bonding, the bonding surfaces become denaturalized, because the active ingredients of the primer, which has polar and non-polar components, permeate into and become oriented in the gap maintaining members 203. Therefore bonding characteristics are greatly improved.

The gap maintaining members 203 must be made of an electrical insulating material, in order to prevent the occurrence of shorting currents with the base layer when they abut against the image carrier. A volume resistivity of $10^{13}$ Ωcm or above is desirable. It is not necessary for the gap maintaining members to be made entirely from insulating material, and provided that at least the portion which abuts against the electrical resistance adjusting layer and the image carrier have insulating properties, then it will be possible to prevent the occurrence of shorting currents.

There are no particular restrictions on the material of the gap maintaining members 203, provided that it is an insulating material and has sufficient elasticity to allow it to follow the dimensional variations of the electrical resistance adjusting layer 202. However, a polyethylene or fluorine resin, or the like, is desirable, since it has excellent slidability with respect to the photosensitive body 101, is sufficiently soft not to damage the photosensitive body 101, and is not liable to adherence of toner, among other factors.

The electrical resistance adjusting layer 202 is formed from a thermoplastic resin composition which includes a high-polymer ion-conductive material, for example. For the high-polymer ion-conductive material, a high-polymer compound containing a polyether ester amide component is used, for example. Polyether ester amide is an ion-conductive high-polymer material, and the advantages of this material are that it is not liable to produce leaks to the photosensitive body, or surface bleed-out.

Desirably, the volume resistivity of the electrical resistance adjusting layer 202 is $10^6$ to $10^9$ Ωcm. If the resistivity is greater than $10^9$ Ωcm, then the charge volume is insufficient, and it becomes difficult to obtain a sufficient charging potential in order to achieve a uniform image. On the other hand, if the resistivity is less than $10^6$ Ωcm, then voltage concentration (leaking) and abnormal discharge into defective parts in the photosensitive body become liable to occur. As described above, the electrical resistance adjusting layer 202 is made of a thermoplastic resin composition which includes a high-polymer ion-conductive material, for example, but for the aforementioned objective, it is also possible to blend in a prescribed ratio of an insulating thermoplastic resin. There are no particular restrictions on the thermoplastic resin, but possible examples include: generic resins, such as polyethylene, polypropylene, methyl polymethacrylate, polystyrene or copolymers of these, or engineering plastics, such as polycarbonate, polyacetal, and the like. With regard to the blending ratio, if the ratio of the high-polymer ion-conductive material is set to 30 to 100 wt % with respect to 0 to 70 wt % of thermoplastic resin, then the prescribed volume resistivity can be obtained.

If the thickness of the electrical resistance adjusting layer 202 is too small, then abnormal discharge occurs due to leaking, and if it is too large, then it becomes difficult to maintain the surface accuracy. Therefore, desirably, the thickness is equal to or greater than 100 μm and equal to or less than 500 μm.

There are no particular restrictions on the method of manufacturing a thermoplastic resin composition which forms an electrical resistance adjusting layer 202, and it can be manufactured readily by melting and kneading a mixture of respective materials in a dual-shaft mixer, kneader, or the like. The process of forming the electrical resistance adjusting layer 202 on the circumferential surface of the conductive supporting body 201 can be carried out readily by coating the aforementioned thermoplastic resin composition onto the conductive supporting body 201 by means of extrusion molding, ejection molding, or the like.

Furthermore, if the conducting member is composed by forming only an electrical resistance adjusting layer 202 on the conductive supporting body 201, then toner or the like may become attached to the electrical resistance adjusting layer 202, thus leading to a decline in performance. It is possible to eliminate cases of this kind by forming a surface layer on the electrical resistance adjusting layer 202. The resistance value of the surface layer is designed to be greater than the electrical resistance adjusting layer, and this makes it possible to avoid voltage concentration and abnormal discharge (leaking) into defective parts in the photosensitive body. However, if the resistance of the surface layer is made too high, then the charging capacity and the transfer capacity will be insufficient, and therefore it is desirable for the differential in resistance value between the surface layer and the electrical resistance adjusting layer 202 to be $10^3$ Ωcm or less.

For the material which forms the surface layer, it is suitable to use a thermoplastic resin composition, from the viewpoint of good film manufacturability. For the resin material, a fluoride resin, silicon resin, polyamide resin, polyester resin, or the like, has excellent anti-adhesion properties, and is desirable from the viewpoint of preventing adherence of toner. Furthermore, since the resin material is electrically insulating, then the resistance of the surface layer is adjusted by dispersing a conductive material of various kinds in the resin.

The surface layer can be formed on the electrical resistance adjusting layer 202 by dispersing the aforementioned surface layer component material in an organic solvent to create a coating material, and then coating it onto the electrical resistance adjusting layer 202 by spray coating, dipping, or the like. Desirably, the film thickness is approximately 10 to 30 μm.

Below, concrete examples of the present invention are described with reference to the drawings.

Example 1

A resin composition (intrinsic volume resistance: $2\times10^8$ Ωcm) comprising 50 wt % of ABS resin (Denka ABS GR-0500, made by Denki Kagaku Kogyo Co.) and 50 wt % of polyester ester amide (IRGASTAT P18, made by Chiba Specialty Chemicals) was coated by ejection molding to create an electrical resistance adjusting layer 202 on a core axis of stainless steel (outer diameter 8 mm), thereby forming an electrical resistance adjusting layer 202 having an external diameter of 14 mm, and an external diameter in the reduced diameter sections at either end of 11.3 mm. Subsequently, ring-shaped gap maintaining members made of high-density polyethylene resin (Novatech PP HY540, made by Polygem Japan) were fitted and bonded onto the reduced diameter sections on either end of the electrical resistance adjusting layer 202, in order to form gap maintaining members 203.

Thereupon, cutting was carried out to simultaneously finish the outer diameter (maximum diameter) of the gap maintaining members 203 to 12.1 mm, and the outer diameter of the electrical resistance adjusting layer 202, to 12.0 mm, thereby achieving the shape shown in FIG. 15 (where the gap maintaining member 203 has a thickness of 0.4 mm in section A, a thickness of 2 mm in section B, and a width of 8 mm in section C). Next, a surface layer having a thickness of approximately 10 μm was formed by spray coating a mixture (surface resistance: $2\times10^{10}$Ω) consisting of acryl silicone resin (3000 VH-P, made by Kawakami Toryo Co.), isocyanate-based curing agent (made by Kawakami Toryo Co.), and carbon black (30 wt % with respect to the total solid component), onto the surface of the electrical resistance adjusting layer 202. Thereupon, the coated resin was heated and cured for 1 hour in an oven at 80° C., thereby yielding a conductive member.

Example 2

A resin composition (intrinsic volume resistance: $2\times10^8$ Ωcm) comprising 50 wt % of ABS resin (Denka ABS GR-0500, made by Denki Kagaku Kogyo Co.) and 50 wt % of polyester ester amide (IRGASTAT P18, made by Chiba Specialty Chemicals) was coated by ejection molding to create an electrical resistance adjusting layer 202 on a core axis of stainless steel (outer diameter 8 mm), thereby forming an electrical resistance adjusting layer 202 having an external diameter of 14 mm, and an external diameter in the reduced diameter sections at either end of 11.1 mm. Subsequently, ring-shaped gap maintaining members made of high-density polyethylene resin (Novatech PP HY540, made by Polygem Japan) were fitted and bonded onto the reduced diameter sections on either end of the electrical resistance adjusting layer 202, in order to form gap maintaining members 203.

Thereupon, cutting was carried out to simultaneously finish the outer diameter (maximum diameter) of the gap maintaining members 203 to 12.1 mm, and the outer diameter of the electrical resistance adjusting layer 202, to 12.0 mm, thereby achieving the shape shown in FIG. 15 (where the gap maintaining member has a thickness of 0.5 mm in section A, a thickness of 2 mm in section B, and a width of 8 mm in section C). Next, a surface layer having a thickness of approximately 10 μm was formed by spray coating a mixture (surface resistance: $2\times10^{10}$Ω) consisting of acryl silicone resin (3000 VH-O, made by Kawakami Toryo Co.), isocyanate-based curing agent (made by Kawakami Toryo Co.), and carbon black (30 wt % with respect to the total solid component), onto the surface of the electrical resistance adjusting layer. Thereupon, the coated resin was heated and cured for 1 hour in an oven at 80° C., thereby yielding a conductive member.

Example 3

A resin composition (intrinsic volume resistance: $2\times10^8$ Ωcm) comprising 50 wt % of ABS resin (Denka ABS GR-0500, made by Denki Kagaku Kogyo Co.) and 50 wt % of polyester ester amide (IRGASTAT P18, made by Chiba Specialty Chemicals) was coated by ejection molding to create an electrical resistance adjusting layer on a core axis of stainless steel (outer diameter 8 mm), thereby forming an electrical resistance adjusting layer 202 having an external diameter of 14 mm, and an external diameter in the reduced diameter sections at either end of 10.9 mm. Subsequently, ring-shaped gap maintaining members 203 made of high-density polyethylene resin (Novatech PP HY540, made by Polygem Japan) were fitted and bonded onto the reduced diameter sections on either end of the electrical resistance adjusting layer, in order to form gap maintaining members.

Thereupon, cutting was carried out to simultaneously finish the outer diameter (maximum diameter) of the gap maintaining members to 12.1 mm, and the outer diameter of the electrical resistance adjusting layer 202, to 12.0 mm, thereby achieving the shape shown in FIG. 15 (where the gap maintaining member has a thickness of 0.6 mm in section A, a thickness of 2 mm in section B, and a width of 8 mm in section C). Next, a surface layer having a thickness of approximately 10 μm was formed by spray coating a mixture (surface resistance: $2\times10^{10}\Omega$) consisting of acryl silicone resin (3000 VH-P, made by Kawakami Toryo Co.), isocyanate-based curing agent (made by Kawakami Toryo Co.), and carbon black (30 wt % with respect to the total solid component), onto the surface of the electrical resistance adjusting layer 202. Thereupon, the coated resin was heated and cured for 1 hour in an oven at 80° C., thereby yielding a conductive member.

Example 4

A resin composition (intrinsic volume resistance: $2\times10^{8}$ Ωcm) comprising 50 wt % of ABS resin (Denka ABS GR-0500, made by Denki Kagaku Kogyo Co.) and 50 wt % of polyester ester amide (IRGASTAT P18, made by Chiba Specialty Chemicals) was coated by ejection molding to create an electrical resistance adjusting layer on a core axis of stainless steel (outer diameter 8 mm), thereby forming an electrical resistance adjusting layer 202 having an external diameter of 14 mm, and an external diameter in the reduced diameter sections at either end of 10.9 mm. Subsequently, ring-shaped gap maintaining members 203 made of high-density polyethylene resin (Novatech PP HY540, made by Polygem Japan) were fitted and bonded onto the reduced diameter sections on either end of the electrical resistance adjusting layer, in order to form gap maintaining members.

Thereupon, cutting was carried out to simultaneously finish the outer diameter (maximum diameter) of the gap maintaining members to 12.1 mm, and the outer diameter of the electrical resistance adjusting layer, to 12.0 mm, thereby achieving the shape shown in FIG. 15 (where the gap maintaining member has a thickness of 0.5 mm in section A, a thickness of 1 mm in section B, and a width of 8 mm in section C). Next, a surface layer having a thickness of approximately 10 μm was formed by spray coating a mixture (surface resistance: $2\times10^{10}\Omega$) consisting of acryl silicone resin (3000 VH-P, made by Kawakami Toryo Co.), isocyanate-based curing agent (made by Kawakami Toryo Co.), and carbon black (30 wt % with respect to the total solid component), onto the surface of the electrical resistance adjusting layer 202. Thereupon, the coated resin was heated and cured for 1 hour in an oven at 80° C., thereby yielding a conductive member.

Comparative Example 1

A rubber composition (volume resistance: $4\times10^{8}$ Ωcm) made by blending 3 parts by weight of ammonium perchlorate with 100 parts by weight of epichlorohydrin rubber (Epichlomer CG, made by Daiso) was formed by extrusion, vulcanized and then coated as an electrical resistance adjusting layer 202 onto a core axis made of stainless steel (outer diameter 8 mm), whereupon it was finished to an outer diameter of 12 mm by cutting. Thereupon, a surface layer having a thickness of 10 μm was formed on the surface of the electrical resistance adjusting layer, using a mixture (surface resistance: $2\times10^{10}$ Ωcm) comprising polyvinylbutylal resin (Denka butylal 3000-K, made by Denki Kagaku Kogyo, Co.), an isocyanate-based curing agent, and tin oxide (60 wt % with respect to the total solid component). Next, ring-shaped gap maintaining members (outer diameter 12.1 mm) made of polyimide resin (Novamide 1010C2, made by Mitsubishi Engineering Plastics) were fitted onto and bonded to either end section, thereby yielding a conductive member.

Comparative Example 2

A rubber composition (volume resistance: $4\times10^{8}$ Ωcm) made by blending 3 parts by weight of ammonium perchlorate with 100 parts by weight of epichlorohydrin rubber (Epichlomer CG, made by Daiso) was formed by extrusion, vulcanized and then coated as an electrical resistance adjusting layer onto a core axis made of stainless steel (outer diameter 8 mm), whereupon it was finished to an outer diameter of 12 mm by cutting. Thereupon, a surface layer having a thickness of 10 μm was formed on the surface of the electrical resistance adjusting layer, using a mixture (surface resistance: $2\times10^{10}$ Ωcm) comprising polyvinylbutylal resin (Denka butylal 3000-K, made by Denki Kagaku Kogyo, Co.), an based-based curing agent, and tin oxide (60 wt % with respect to the total solid component). Next, tape-shaped members (Daitac PF025-H made by Dai Nippon Ink Co.) having a width of 8 mm and a thickness of 60 μm were coated as gap maintaining members about the circumference of each end section, thereby yielding a conductive member.

Comparative Example 3

A resin composition (intrinsic volume resistance: $2\times10^{8}$ Ωcm) comprising 50 wt % of ABS resin (Denka ABS GR-0500, made by Denki Kagaku Kogyo) and 50 wt % of polyether ester amide (IRGASTAT P18, made by Chiba Specialty Chemicals) was coated by ejection molding to create an electrical resistance adjusting layer on a core axis of stainless steel (outer diameter 8 mm). Next, ring-shaped gap maintaining members made of polyimide resin (Novamide 1010C2, made by Mitsubishi Engineering Plastics) were fitted onto and bonded to either end section, and cutting was carried out to simultaneously finish the outer diameter (maximum diameter) of the gap maintaining members 203 to 12.1 mm, and the outer diameter of the electrical resistance adjusting layer 202, to 12.0 mm, thereby achieving the shape shown in FIG. 3. Subsequently, a surface layer having a thickness of 10 μm was formed on the surface thereof, using a mixture (surface resistance: $2\times10^{10}$ Ωcm) comprising polyvinylbutylal resin (Denka butylal 3000-K, made by Denki Kagaku Kogyo, Co.), an based-based curing agent, and tin oxide (60 wt % with respect to the total solid component), thus yielding a conductive member.

(Test 1)

The conductive member described above was installed in the image forming apparatus shown in FIG. 1, as a charging roller, and the size of the gap between the charging member and the photosensitive body was measured in a normal temperature environment (23° C., 60% RH). Thereupon, it was left for 24 hours in respective environments: LL; 10° C., 65% RH, and HH; 30° C., 90% RH, the size of the gap between the charging member and the photosensitive body was measured in each of the environments, and the amount of change in the gap size between the respective environments was calculated. The corresponding evaluation results are shown in FIG. 16. In FIG. 16, it can be seen that results showing little variation in the gap size, and little change between different environments, are obtained.

(Test 2)

Furthermore, setting the applied voltage to DC=−800V, AC=2400 Vpp (frequency=2 kHz), 300,000 sheets of paper were passed, and the gap size between the charging member and the photosensitive body, the state of the roller surface, and the image, were evaluated. The evaluation environment was switched every 10,000 sheets, between respective environments of 23° C., 60% RH, LL; 10° C., 65% RH, HH, 30° C., 90%. The corresponding evaluation results are also shown in FIG. 16.

In FIG. 16, satisfactory results were obtained for each of the rollers according to the examples, but problems were observed in the rollers according to the comparative examples.

Figure 17:
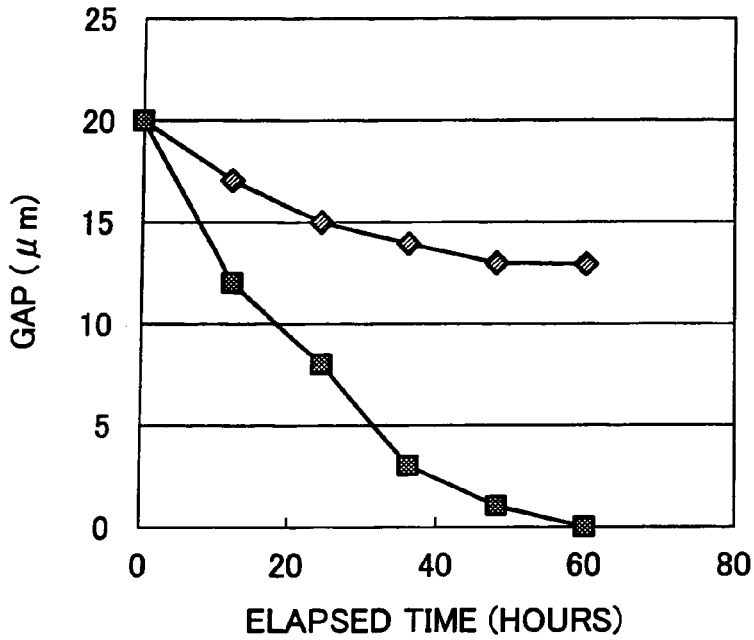
FIG. 17 is a diagram showing the beneficial effects of the present embodiment.

FIG. 17 shows a comparison between a charging roller relating to the present embodiment (FIG. 5) and a charging roller according to the prior art in terms of the temporal change of the gap between the electrical resistance adjusting layer 202 and the image carrier surface abutting against same, in a high-temperature and high-humidity environment. In FIG. 17, it can be seen that in the case of the charging roller according to the present embodiment, the gap remains stable over a long period of time, in comparison with the charging roller of the prior art.

According to the present embodiment, peeling at the end sections of the gap maintaining members 203 does not occur during processing, and the gap with respect to the photosensitive body 101 is kept to a uniform gap with good accuracy. Furthermore, even if there is a change in the dimensions of the electrical resistance adjusting layer on which the gap maintaining members 203 are installed, due to changes in the ambient conditions, then these changes in the electrical resistance adjusting layer 202 can be followed by the gap maintaining members 203 and hence variations in the gap can be suppressed.

Furthermore, according to the present embodiment, a height differential between the gap maintaining members 203 and the electrical resistance adjusting layer 202 is formed by means of integrated processing based on removal processing, and hence the accuracy of the height differential can be further increased.

Moreover, according to the present embodiment, by bonding and fixing the gap maintaining members 203 onto the electrical resistance adjusting layer 202, the gap maintaining members 203 are fixed reliably over a long period by the bonding force between the resins. Furthermore, positional displacement of the gap maintaining members 203 during the removal processing is prevented, and hence a highly precise gap can be maintained.

Moreover, according to the present embodiment, by bonding and fixing gap maintaining members 203 onto the electrical resistance adjusting layer 202, via a primer provided on the gap maintaining members 203, an even stronger bond is obtained between the resins, and hence the gap maintaining members 203 are fixed reliably over a long period of time, and positional displacement of the gap maintaining members 203 during the removal processing is prevented. Therefore, it is possible to maintain a highly precise gap.

Furthermore, according to the present embodiment, since at least the portion of the gap maintaining members 203 which abuts against the image carrier are made of a material having insulating properties, then it is possible to prevent the occurrence of abnormal discharge (leaks) between the gap maintaining members 203 and the base layer of the image carrier 101, when a high voltage is applied to the conductive member.

Moreover, according to the present embodiment, by forming a surface layer on the electrical resistance adjusting layer 202, it is possible to prevent the toner and additives added to the toner from becoming attached to the surface of the conductive member, over a long period of time.

Furthermore, according to the present embodiment, the resistance of the surface layer is made greater than the resistance of the electrical resistance adjusting layer 202, and therefore it is possible to prevent the occurrence of voltage concentrations or abnormal discharges into defective sections of the image carrier when a high voltage is applied to the conductive member.

According to the present embodiment, since the conductive member is formed to a cylindrical shape, then continuous discharge from the same position is prevented by the rotation of the conductive member, and hence an extended lifespan can be achieved.

In the present embodiment, desirably, the conductive supporting body is a charging member. Consequently, it is possible to achieve uniform charging of an image carrier, for example.

Moreover, in the present embodiment, a charging apparatus comprising a charging roller 102 which is constituted by a conductive member is formed integrally with the image carrier 101, and it is detachable with respect to the main body of an image forming apparatus. Consequently, it is possible to provide a cartridge which facilitates replacement of the charging roller 102, for example.

In the present embodiment, it is possible to obtain high-quality images, stably, over a long period of time, by installing the process cartridge described above in an image forming apparatus of an electrophotographic type, for example.

As described above, according to the present invention, it is possible precisely to control the gap between the electrical resistance adjusting layer surface and the surface of an abutting member, for example, a photosensitive body, as well as being able to prevent the occurrence of abnormal discharges, for example, and furthermore, to avoid variations in the height differential between the outer circumferential surface of the gap maintaining members and the outer circumferential surface of the electrical resistance adjusting layer, even if the ambient conditions change.

Various modifications will become possible for those skilled in the art after receiving the teachings of the present disclosure without departing from the scope thereof.

What is claimed is:

1. A conductive member, comprising:

a long conductive supporting body;

an electrical resistance adjusting layer, disposed on the outer circumferential surface of the conductive supporting body and having a reduced diameter section at either end; and a pair of gap maintaining members which are respectively fitted onto said reduced diameter sections of the electrical resistance adjusting layer, wherein the outer circumferential surfaces of said gap maintaining members have a height differential with respect to the outer circumferential surface of said electrical resistance adjusting layer, in such a manner that when abutted against an image carrier, a prescribed gap is formed between the outer circumferential surface of said image carrier and the outer circumferential surface of said electrical resistance adjusting layer, and taking $X_3$ to be the interval between the end faces of said electrical resistance adjusting layer and the faces of said gap maintaining members opposing the end faces, the relationship 0.1 mm$\leqq X_3 \leqq$1 mm is satisfied, wherein a ratio B/A between an outer diameter B of the reduced diameter sections on either end of said electrical resistance adjusting layer, and an outer diameter A of said electrical resistance adjusting layer, is 0.87 to 0.97.

2. The conductive member as claimed in claim 1, wherein the gap between said electrical resistance adjusting layer and the surface of said image carrier is 10 to 50 μm.

3. The conductive member as claimed in claim 1, wherein the thickness of the portions of said gap maintaining members which fit onto the reduced diameter sections of said electrical resistance adjusting layer is equivalent to 7 to 12% of the outer diameter A of said electrical resistance adjusting layer.

4. The conductive member as claimed in claim 1, wherein, after fitting said gap maintaining members onto the reduced diameter sections on the end sections of said electrical resistance adjusting layer, said height differential is formed by performing processing on the outer circumferential surface of said gap maintaining members and the outer circumferential surface of said electrical resistance adjusting layer.

5. The conductive member as claimed in claim 1, wherein said gap maintaining members are bonded and fixed to the reduced diameter sections of the electrical resistance adjusting layer.

6. The conductive member as claimed in claim 1, wherein primer is applied to the surfaces of said gap maintaining members, and said gap maintaining members are bonded and fixed to the reduced diameter sections of said electrical resistance adjusting layer via this primer.

7. The conductive member as claimed in claim 1, wherein at least the portion of said gap maintaining members which abuts against said image carrier have insulating properties.

8. The conductive member as claimed in claim 1, wherein a surface layer is formed on the outer circumferential surface of said electrical resistance adjusting layer.

9. The conductive member as claimed in claim 8, wherein the resistance of said surface layer is greater than the resistance of said electrical resistance adjusting layer.

10. The conductive member as claimed in claim 1, wherein the conductive supporting body has a cylindrical shape.

11. The conductive member as claimed in claim 1, wherein said conductive supporting body is a charging member.

12. A charging roller of a charging apparatus which uniformly charges the surface of an image carrier of an image forming apparatus, wherein the charging roller is constituted by a conductive member which comprises:

a long conductive supporting body;

an electrical resistance adjusting layer, disposed on the outer circumferential surface of the conductive supporting body and having a reduced diameter section at either end; and a pair of gap maintaining members which are respectively fitted onto said reduced diameter sections of the electrical resistance adjusting layer, wherein the outer circumferential surfaces of said gap maintaining members have a height differential with respect to the outer circumferential surface of said electrical resistance adjusting layer, in such a manner that when abutted against the image carrier, a prescribed gap is formed between the outer circumferential surface of said image carrier and the outer circumferential surface of said electrical resistance adjusting layer, and taking $X_3$ to be the interval between the end faces of said electrical resistance adjusting layer and the faces of said gap maintaining members opposing the end faces, the relationship 0.1 mm$\leqq X_3 \leqq$1 mm is satisfied, wherein a ratio B/A between an outer diameter B of the reduced diameter sections on either end of said electrical resistance adjusting layer, and an outer diameter A of said electrical resistance adjusting layer, is 0.87 to 0.97.

13. A process cartridge in which an image carrier and a charging apparatus arranged in the proximity of the image carrier are integrally formed, the process cartridge being formed detachably with respect to the main body of an image forming apparatus, wherein said charging apparatus comprises a charging roller which uniformly charges the surface of the image carrier of the image forming apparatus, wherein the charging roller is constituted by a conductive member which comprises:

a long conductive supporting body;

an electrical resistance adjusting layer, disposed on the outer circumferential surface of the conductive supporting body and having a reduced diameter section at either end; and a pair of gap maintaining members which are respectively fitted onto said reduced diameter sections of the electrical resistance adjusting layer, wherein the outer circumferential surfaces of said gap maintaining members have a height differential with respect to the outer circumferential surface of said electrical resistance adjusting layer, in such a manner that when abutted against the image carrier, a prescribed gap is formed between the outer circumferential surface of said image carrier and the outer circumferential surface of said electrical resistance adjusting layer, and taking $X_3$ to be the interval between the end faces of said electrical resistance adjusting layer and the faces of said gap maintaining members opposing the end faces, the relationship 0.1 mm$\leqq X_3 \leqq$1 mm is satisfied, wherein a ratio B/A between an outer diameter B of the reduced diameter sections on either end of said electrical resistance adjusting layer, and an outer diameter A of said electrical resistance adjusting layer, is 0.87 to 0.97.

14. An image forming apparatus, comprising:

an image carrier;

a charging apparatus having a charging roller according to claim 12 which charges the surface of the image carrier;

an exposure apparatus which writes a latent image by exposing the charged surface of the image carrier on the basis of image data;

a developing apparatus which supplies toner to the electrostatic latent image formed on the surface of the image carrier to make the image visible;

a cleaning apparatus which recovers toner remaining on the surface of said image carrier after image transfer; and a process cartridge in which the image carrier and the charging apparatus arranged in the proximity of the image carrier are integrally formed, the process cartridge being formed detachably with respect to the main body of an image forming apparatus.

15. An image forming apparatus comprising:

an image carrier;

a charging apparatus which charges the surface of an image carrier;

an exposure apparatus which writes a latent image by exposing the charged surface of the image carrier on the basis of image data;

a developing apparatus which supplies toner to the electrostatic latent image formed on the surface of the image carrier to make the image visible;

a cleaning apparatus which recovers toner remaining on the surface of said image carrier after image transfer; and a charging roller of the charging apparatus which uniformly charges the surface of an image carrier of an image forming apparatus, wherein the charging roller is constituted by a conductive member which comprises:

a long conductive supporting body;

an electrical resistance adjusting layer, disposed on the outer circumferential surface of the conductive supporting body and having a reduced diameter section at either end; and a pair of gap maintaining members which are respectively fitted onto said reduced diameter sections of the electrical resistance adjusting layer, wherein the outer circumferential surfaces of said gap maintaining members have a height differential with respect to the outer circumferential surface of said electrical resistance adjusting layer, in such a manner that when abutted against the image carrier, a prescribed gap is formed between the outer circumferential surface of said image carrier and the outer circumferential surface of said electrical resistance adjusting layer, and taking $X_3$ to be the interval between the end faces of said electrical resistance adjusting layer and the faces of said gap maintaining members opposing the end faces, the relationship $0.1\ \text{mm} \leqq X_3 \leqq 1\ \text{mm}$ is satisfied, wherein a ratio B/A between an outer diameter B of the reduced diameter sections on either end of said electrical resistance adjusting layer, and an outer diameter A of said electrical resistance adjusting layer, is 0.87 to 0.97.

* * * * *